United States Patent [19]

May

[11] Patent Number: 4,949,888

[45] Date of Patent: Aug. 21, 1990

[54] HUNTER'S SUSPENDERS

[75] Inventor: Everett L. May, Cheshire, Oreg.

[73] Assignee: May Manufacturing, Ltd., Lebanon, Oreg.

[21] Appl. No.: 447,431

[22] Filed: Dec. 7, 1989

[51] Int. Cl.[5] ..... F42B 39/02

[52] U.S. Cl. ..... 224/203; 224/209; 224/223; 2/328

[58] Field of Search ..... 224/203, 223, 205, 209, 224/214; 2/94, 310, 328, 300

[56] References Cited

U.S. PATENT DOCUMENTS

| | | | |
|---|---|---|---|
| 120,584 | 11/1871 | Harris | 2/300 |
| 394,721 | 12/1888 | Pell et al. | 2/300 |
| 421,519 | 2/1890 | Rosenstock | 2/300 |
| 894,907 | 8/1908 | Schad | 2/300 |
| 1,016,231 | 1/1912 | Robie | 224/203 |
| 1,800,731 | 4/1931 | Hudkins | 224/203 |

FOREIGN PATENT DOCUMENTS

| | | | |
|---|---|---|---|
| 2595220 | 9/1987 | France | 224/206 |

*Primary Examiner*—Linda J. Sholl
*Attorney, Agent, or Firm*—John F. Ingman

[57] ABSTRACT

Hunter's suspenders, which feature removable front sections designed to carry a variety of sizes of ammunition, include a shoulder and back section, formed of two lengths of longitudinally elasticized webbing, which attach to the back of the hunter's pants, preferably cross and are joined, and have detachable connectors at their front ends. Two front sections each include a length of longitudinally elasticized webbing, with detachable connectors at their upper ends which are compatible with the connectors of the front ends of the shoulder and back section. The lower end of the front sections attach to a front location of the hunter's pants. A second length of longitudinally elasticized webbing is oriented adjacent and parallel to the first webbing length of the front section, and is attached thereto by equally spaced transverse attachments, such as by sewing, wherein a plurality of transverse tubes of expandable diameter are formed into which ammunition may be inserted for carrying. Front sections may be constructed with different spacing of the transverse attachments, so that the hunter may, by replacing one detachable front section with another, switch from one size of ammunition to another without replacing the entire suspenders unit. Additional front sections may be transported in a preloaded configuration, allowing quick replacement of ammunition without having to individually reload the ammunition tubes.

4 Claims, 2 Drawing Sheets

HUNTER'S SUSPENDERS

BACKGROUND OF THE INVENTION

1. Field of the Invention

This invention involves suspenders for use while hunting, and, more particularly, an elastic suspender configuration which utilizes alternative removable front sections having a capability of holding various sizes of rifle and pistol cartridges and shotgun shells.

2. Description of the Prior Art

Various suspender configurations have been developed which encompass a capacity to carry additional articles. U.S. Pat. No. 120,584 provides a safety pocket on the inside of the suspender straps for securing and concealment of jewelry and other valuables. U.S. Pat. No. 394,721 discloses an external pocket attached to a length adjusting suspender end, for carrying pencils, spectacles and the like. U.S. Pat. No. 421,519 discloses suspenders with multiple, length-adjusting button holes, wherein a separate pocket element may be attached between two such button holes. U.S. Pat. No. 894,907 discloses a link element between the suspender web and strap, which provides a holder for one or more pencils.

Hunters characteristically carry extra ammunition while hunting. These cartridges or shells may be carried loose, as in jacket or pants pockets. However, it is more convenient and efficient to carry the cartridges or shells in a readily available and ordered manner, such as in the loops provided by a cartridge-type holder. Since most hunters participate in the hunting of a variety of game, a capability to carry different types and sizes of ammunition is highly desirable.

Additionally, many hunters have found it to be highly desirable to wear loose clothing, to include loose fitting pants which are best held in proper position by conventional over-the-shoulder suspenders.

What is needed is a device for carrying hunting ammuniton which:

1. Provides a convenient, accessible location and ordered means of carrying ammunition;
2. Carries either rifle and pistol cartridges or shotgun shells, or both concurrently; and
3. Provides adjustable over-the-shoulder suspension means for holding the hunter's pants in proper position.

SUMMARY OF THE INVENTION

The present invention provides hunter's suspenders which meet the aforementioned need. The suspenders include removable front sections which may be designed to carry either rifle and pistol cartridges and smaller shotgun shells, or larger shotgun shells.

Accordingly, in the preferred embodiment, the hunter's suspenders include a shoulder and back section, formed of two lengths of longitudinally elasticized webbing, each having means, such as a locking clip, for connecting a back end of each webbing length to the hunter's pants at a back location thereof. The two webbing lengths preferably cross intermediate to their ends, and are joined together at such crossing. Detachable connecting means are attached at the front ends of the webbed lengths, corresponding to a position generally at the front of the shoulders of the user. Length adjustment means may also be located proximate the front ends of the webbing lengths of the shoulder and back section.

Two front sections each include a first length of longitudinally elasticized webbing, with detachable connecting means at their upper ends which is compatible with engaging the detachable connecting means of the front ends of the shoulder and back section. Located at the lower end of the front sections first webbing lengths are means for connecting, such as locking clips, to engage a front location on the hunter's pants. Length adjustment means may also be incorporated proximate to the lower end of the front sections' first webbing lengths. A second length of longitudinally elasticized webbing, identical to the first webbing length except for being of shorter length, is oriented adjacent and parallel to a portion of the first webbing length. The second webbing length may be a separate piece or may be an extension of the first webbing length which is folded transversely into its position against the first webbing length. The second webbing length is attached to the first webbing length by an equally spaced series of transverse attachments, such as by sewing, wherein each pair of adjacent transverse attachments, in conjunction with the first and second webbing lengths included therebetween, form a transverse tube of expandable diameter into which a single unit of ammunition may be inserted for carrying. The spacing of the transverse attachment means, in combination with the longitudinal elasticity of the webbing, will permit a range of sizes of hunting ammunition to be carried in a certain front section. Several front sections, constructed with different spacing of the transverse attachment means, allow the hunter to quickly replace one detachable front section with another, thereby changing the carrying capacity, such as from rifle cartridges to shotgun shells, without replacing the entire suspenders unit. If desired, additional front sections may be transported in a pre-loaded configuration, allowing quick replacement of ammunition which is readily available, without having to individually reload the ammuntion carrying section. When the hunter is concurrently hunting a variety of game, he may choose to utilize one front section sized for shotgun shells and a second front section sized for smaller shells or cartridges.

DESCRIPTION OF THE PREFERRED EMBODIMENT

Figure 1:
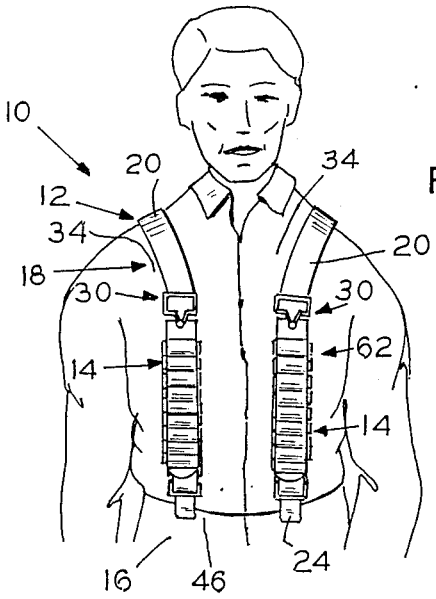
FIG. 1 illustrates a front view of the hunter's suspenders as worn by an individual.

Turning now to the drawings, there is shown in FIG. 1 an individual user 10 wearing the hunter's suspenders 12 of the present invention. The hunter's suspenders 12 feature detachable front sections 14, which have a capability of handling different sizes of ammunition, so as to allow the hunter 10 to quickly and easily replace one detachable front section 14 with another, thereby changing types of ammunition or replenishing with preloaded front sections 14, without having to replace the entire suspender's unit or reload the ammunition holding portion. The hunter's suspenders 12, in addition to providing a convenient, accessible location and ordered means of carrying a variety of ammuniton, also provides adjustable, over-the-shoulder suspension means for holding the hunter's pants 16 in a proper position.

Figure 2:
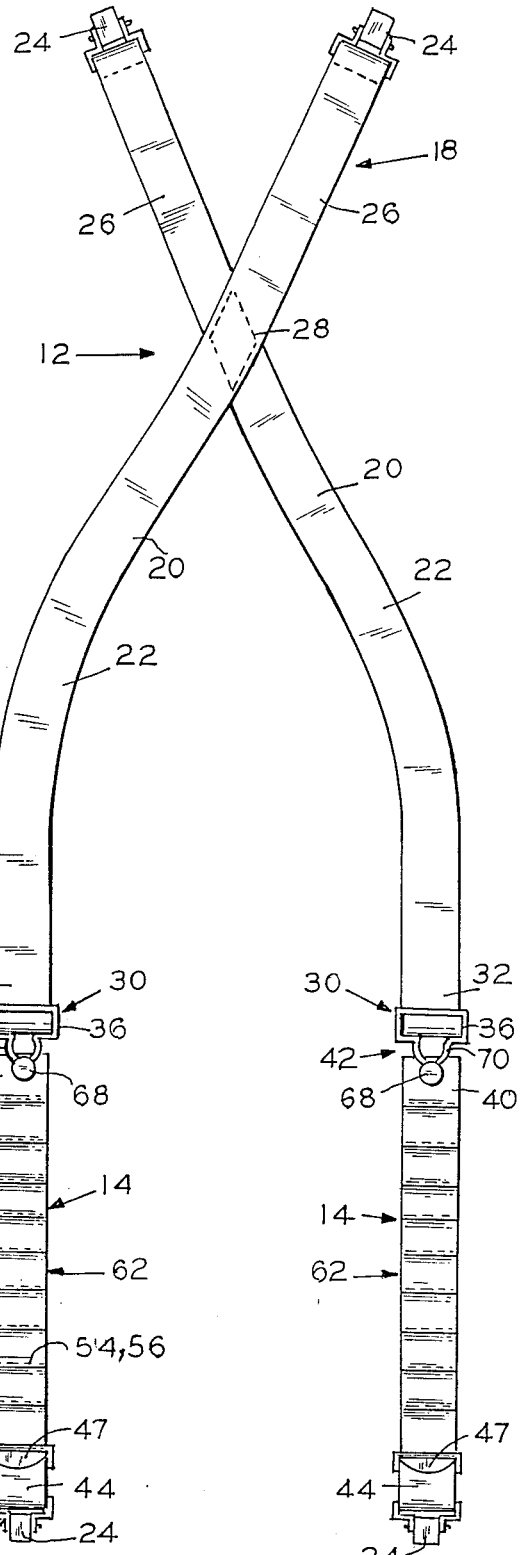
FIG. 2 illustrates a plan view of the hunter's suspenders.
Figure 3:
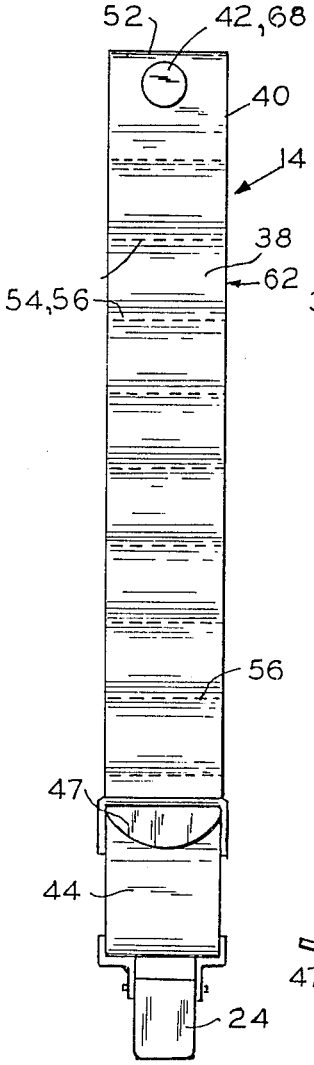
FIG. 3 illustrates a front view of a removable front section of the hunter's suspenders.
Figure 4:
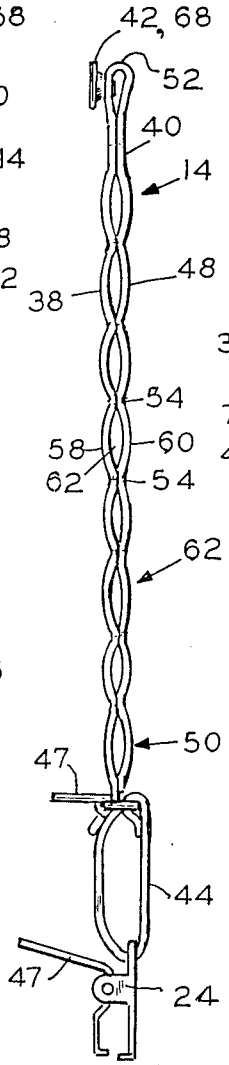
FIG. 4 illustrates a side view of the removable front section of FIG. 3, with length adjustment and pants connecting means open.

FIG. 2 illustrates a plan view of the hunter's suspenders 12. The suspenders 12 include a shoulder and back section 18, formed of two lengths 20 of longitudinally elasticized webbing 22. Each length of webbing 20 has means, such as a conventional locking clip 24, as illustrated, for connecting a back end 26 to the hunter's pants 16 at a back location (not shown) thereof. The two webbing lengths 20 preferably cross, as at 28, and are joined together at such crossing 28, as by sewing. Detachable connecting means 30, discussed further below, are attached to the front ends 32 of the webbed lengths 20, corresponding generally to a position at the front of the shoulders 34 of the user 10. Length adjustment means 36 may also be located near or at the front ends 32 of the webbing lengths 20 of the shoulder and back section 18.

Figure 5:
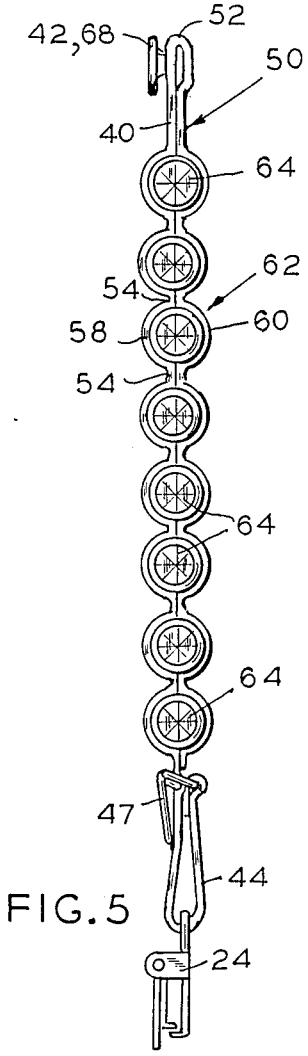
FIG. 5 illustrates a side view of the removable front section of FIG. 4, where the front section is loaded with shotgun shells.
Figure 6:
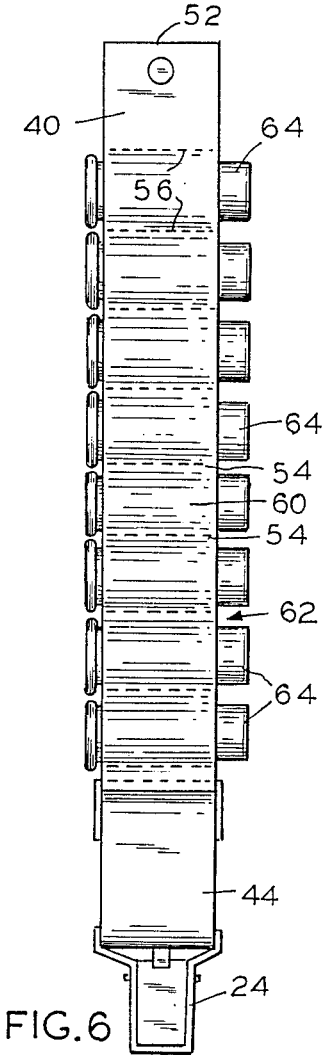
FIG. 6 illustrates a back view of a front section loaded with shotgun shells.
Figure 7:
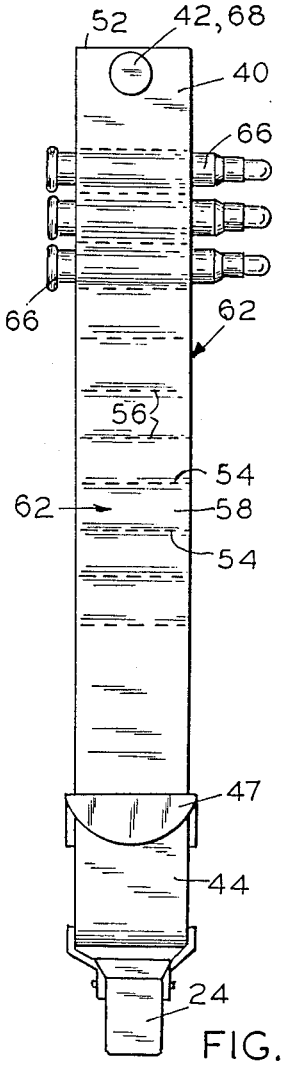
FIG. 7 illustrates a front view of an alternative removable front section which is partially loaded with rifle cartridges.

As seen in FIG. 2 and in greater detail in FIGS. 3 through 7, the two front sections 14 each include a first length 38 of longitudinally elasticized webbing 22, preferably the same webbing material 22 as used for the shoulder and back section 18. This first length of webbing 38 utilizes at its upper end 40 a detachable connecting means 42 which is compatible with engaging the detachable connecting means 30 of the shoulder and back section 18. At the lower end 44 of the first length of webbing 38 of the front section 14 is a means of connecting, such as the locking clip 24, as illustrated, for connecting the lower end 44 to a front location 46 on the hunter's pants 16. Also proximate to the lower end 44 may be located a length adjusting means, a toothed clamp 47 working well, as illustrated. A second webbing length 48 of longitudinally elasticized webbing material 22, preferably the same as the first webbing length 38 except for a shorter length, is oriented adjacent and parallel to the first webbing length 38 as at position 50. The second webbing length 48 may be a separate piece, or as illustrated, may be an extension of the first webbing length 38 which is folded transversely, as at 52, into its position 50 against the first webbing length 38. The second webbing length 48 is attached to the first webbing length 38 by an equally spaced series of transverse attachments 54; a simple sewing attachment 56, as illustrated, has proved to be satisfactory. Each transverse attachment 54, combined with an adjacent transverse attachment 54 and sections 58 and 60 of the first webbing length 38 and the second webbing length 48, respectively, which are included between the adjacent transverse attachments 54, form an expandable holding tube 62, best seen in FIGS. 4 and 5, into which a single unit of ammunition, for example shotgun shells 64 as seen in FIGS. 5 and 6 or rifle cartridges 66, as seen in FIG. 7, may be inserted. The spacing of the transverse attachments 54, in combination with the longitudinal elasticity of the webbing 22 used, will permit a range of sizes of hunting ammuniton to be carried in a certain front section 14. Utilizing the longitudinally elasticized webbing produced as type 1925HR by George C. Moore Co. of Ebenton, N.C., a ⅝-inch spacing between transverse attachments 54 provides a suitable holding tube 62 for rifle and pistol ammunition, except 0.22 caliber, and for 0.410 shotgun shells. A one-inch separation between transverse attachments 54 is suitable for larger shotgun shells, including 20 gauge through 12 gauge. A preferred width of the webbing is 1½-inches, and either a plain color or camouflage appearance may be used, with bright red suspenders 12 being preferred for safety reasons.

Figure 8:
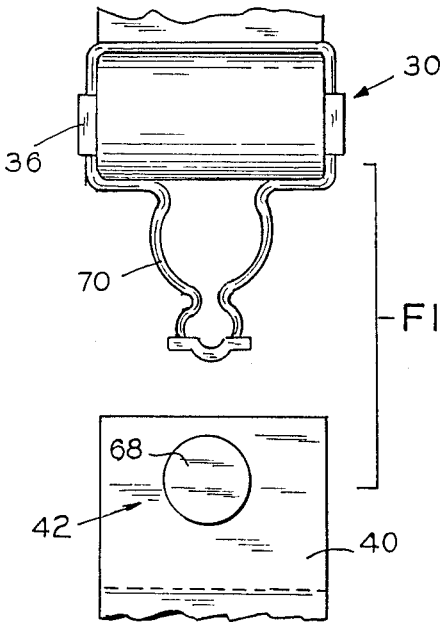
FIG. 8 illustrates a front view of the connecting means between the back and shoulder section and a removable front section.
Figure 9:
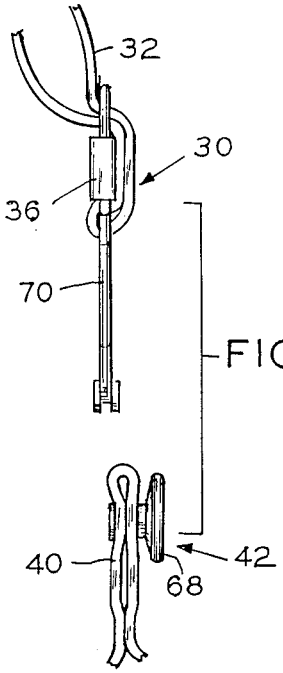
FIG. 9 illustrates a side view of the connecting means of FIG. 8.

The means of detachable connection 30 and 42, between the front ends 32 of the shoulder and back section 18 and the upper end 38 of the front sections 14, respectively, can be any of a number of forms. A metal button 68 extending to the front at the upper end 40 of the front section 14 is preferred for detachable connecting means 42. While the corresponding connecting means 30 at the front end 32 of the webbing lengths 20 could be as simple as a button hole (not shown), the preferred connecting means 30 is the loop or slide member 70, as is commonly found on overalls. Such loop or slide member 70 not only is easy and simple to attach and detach, fitting the purpose of the hunter's suspenders 12, it commonly has length adjustment means 36 incorporated therein, so as to allow the user 10 to adjust the length of the suspenders 12 through adjusting the length of the webbing 20 near at the front ends 32 of the shoulder and back section 18. This preferred means of attachment, reflecting overall garment attachments 68 and 70, is illustrated in FIGS. 8 and 9.

As indicated above, several front sections 14, constructed with different spacing of the transverse attachments 54, allow the hunter 10 to quickly replace one detachable front section 14 with another, thereby changing the carrying capacity, such as from rifle cartridges 66 to shotgun shells 64, without replacing the entire suspenders 12. If desired, the front sections 14 also may be transported in a pre-loaded configuration, allowing quick replenishment of ammuniton without having to individually reload the ammunition carrying section. When the hunter 10 is concurrently hunting a variety of game, he may choose to utilize one front section 14 sized for shotgun shells 64 and a second front section 14 sized for smaller shells or cartridges.

It is thought that the hunter's suspenders of the present invention and their many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. Suspenders, which comprise:

a. a shoulder and back section, formed of:

(1) two lengths of longitudinally elasticized webbing, each having a first end and a second end;

(2) means for connecting the first ends of said webbing lengths to a pant garment at a back location thereof;

(3) said two webbing lengths being joined to each other intermediate said first and second ends; and (4) detachable connecting means attached at said second ends;

b. two front sections, each formed to include:

(1) a first length of longitudinally elasticized webbing, having an upper end and a lower end;

(2) detachable connecting means, at the upper end of said front section, which are engagable with said detachable connecting means located at the second end of a webbing length of said shoulder and back section;

(3) means for connecting the lower end of the webbing length of the front section to a front location of said pant garment; and (4) a second length of longitudinally elasticized webbing which is oriented adjacent and parallel to said first webbing length, whereat the second length is attached to said first webbing length by a plurality of equally spaced transverse attachments, wherein each pair of said adjacent transverse attachments, in combination with the first webbing length and second webbing length included therebetween, form a transverse tube of expandable diameter, into which a single unit of ammunition may be inserted for carrying.

2. The suspenders, as recited in claim 1, wherein the second length of webbing of the front section is a longitudinal extension of the first length of webbing which has been folded transversely into the position for attachment.

3. The suspenders, as recited in claim 1, wherein, additionally, length adjustment means are located proximate the second end of the webbing lengths of said shoulder and back section.

4. The suspenders, as recited in claim 1, wherein, additionally, length adjustment means are located proximate the lower end of the first webbing lengths of the front sections.

* * * * *